United States Patent [19]

Marlowe et al.

[11] Patent Number: 4,748,701

[45] Date of Patent: Jun. 7, 1988

[54] SAFETY PATIENT LIFT AND TRANSFER SLING

[76] Inventors: Harold E. Marlowe, P.O. Box 2295, Fort Oglethorpe, Ga. 30742; Gerald C. Baker, 3051 Towerway Dr., Chattanooga, Tenn. 37406; Janet P. Biggerstaff, 670 Charbell, Hixson, Tenn. 37343

[21] Appl. No.: 899,908

[22] Filed: Aug. 25, 1986

[51] Int. Cl.[4] ..... A61G 1/00; A61G 7/10

[52] U.S. Cl. ..... 5/89; 5/81 B

[58] Field of Search ..... 5/89, 84, 83, 86, 81 R, 5/85, 87, 88; 128/133, 134

[56] References Cited

U.S. PATENT DOCUMENTS

| | | | |
|---|---|---|---|
| D. 268,232 | 3/1983 | Scales . | |
| 737,398 | 8/1903 | Grote | 5/89 X |
| 1,523,217 | 1/1925 | Juerges | 5/89 X |
| 1,569,045 | 1/1926 | Sommer | 5/89 X |
| 1,971,294 | 8/1934 | Bunker | 5/89 |
| 2,309,464 | 1/1943 | Lucci et al. | 5/89 X |
| 2,793,768 | 5/1957 | Schaedler | 5/89 X |
| 3,234,568 | 2/1966 | Fischer | 5/89 |
| 3,859,677 | 1/1975 | Nordwig | 5/89 |
| 4,070,721 | 1/1978 | Stasko | 5/89 |
| 4,138,750 | 2/1979 | Michalowski | 5/89 |

FOREIGN PATENT DOCUMENTS

| | | | |
|---|---|---|---|
| 13341 | of 1891 | United Kingdom | 5/89 |

*Primary Examiner*—Alexander Grosz

*Attorney, Agent, or Firm*—Alan Ruderman

[57] ABSTRACT

A patient support sling for use with lifting apparatus for transferring a patient between supine and sitting positions has an elongated central seat panel attached at its ends to respective transversely extending thigh and back support panels, and a security panel fastened at the joint between the seat panel and the thigh support panel. The security panel is adapted to be received between the legs of the patient and to engage the patient's chest. Strap members are connected to the rear of the back support panel and are adapted to be looped over the shoulders of the patient and secured to buckle members attached to the security panel so as to draw the security panel against the chest of the patient. The sling provides security to the patient against falling as he or she is being transferred by the lifting apparatus. Additional strap members are disclosed for providing additional security in retaining the patient in the sling.

9 Claims, 1 Drawing Sheet

SAFETY PATIENT LIFT AND TRANSFER SLING

BACKGROUND OF THE INVENTION

This invention relates to the lifting and transporting of immobile patients between a bed and a chair or the like, and more particularly to a sling utilized with a patient lifting crane, the sling having means for securing the patient in the sling to preclude the patient from accidentally falling from the sling while being transported.

In hospitals or the like it is common to utilize a crane type lifting device to raise immobile patients from the supine to the sitting position so as to transfer such patients between a bed and a chair or the like. Immobile and obese patients for whom normal transfer poses the potential for injury to the patient, nurse or other staff member require such lifting devices which conventionally are hydraulically operated. Although such lifts can be operated by one staff person, it is recommended that two be present to stabilize and support the patient. The patient is positioned in a flexible hammock type fabric sling having a central panel member and a transverse panel portion at each end, the sling thus having a substantially H-shaped configuration and the end of a suspension chain is connected to each end of each transverse panel and supported by a hanger carried by the lifting crane. One of the transverse panels supports the thigh the other supports the upper portion of the back of the patient.

One difficulty with the known patient lifting slings is that it provides inadequate support for the patient when being transferred as it provides insufficient support to the chest of the patient. This difficulty has been recognized and an attempt to provide a solution was made in Stasko U.S. Pat. No. 4,070,721. There, it was proposed to sew one end of a strap to the center of the leading edge of the sling which supports the thighs while the other end of the strap is looped about a hanger of the lifting crane. Although this proposal provides additional support to the patient from falling forwardly, it falls short in providing sufficiently safe support for the patient since the patient is not secured in the sling. The strap merely acts to engage the patient when he or she pivots forwardly, but effective support for the chest is not provided.

SUMMARY OF THE INVENTION

Consequently, it is a primary object of the present invention to provide a patient lift and transfer sling for use with a crane type lifting apparatus wherein the patient is securely held in the sling while the patient is being lifted and transferred.

It is another object of the present invention to provide a sling for use to lift and transfer patients from a supine to a sitting position and vice versa, the sling having chest and shoulder supports for securing the patient from falling out of the sling.

It is a further object to provide a lifting and transfer sling for patients which has a safety panel for acting against the chest of the patient to secure the patient in the sling, the safety panel being fastened to the contiguous edge of the central panel and the thigh supporting transverse panel and adjustably connected to the back supporting transverse panel by strap means overlying the shoulder of the patient.

Accordingly, the present invention provides a patient support sling having an elongated central seat panel attached at its ends to a respective transversely extending panel, a first of the transversely extending panel providing a suport for thighs of the patient while the second transversely extending panel provides support for the patient's back, and a security panel fastened to the seat panel preferably at the joint contiguous with the first transversely extending panel, the security panel being adapted to engage the chest of the patient and having means for securely connecting it over the patient's shoulders to the second panel so as to secure the patient in the sling.

The sling of the present invention prevents the patient from falling out of the lifting apparatus during transfer and provides a sense of security to the patient so as not to fear the lifting and transferring procedure. With the sling of the present invention patient can be transferred easily by one staff member of a hospital or the like without accidently slipping out of the sling as has occurred on occasion with prior art slings.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
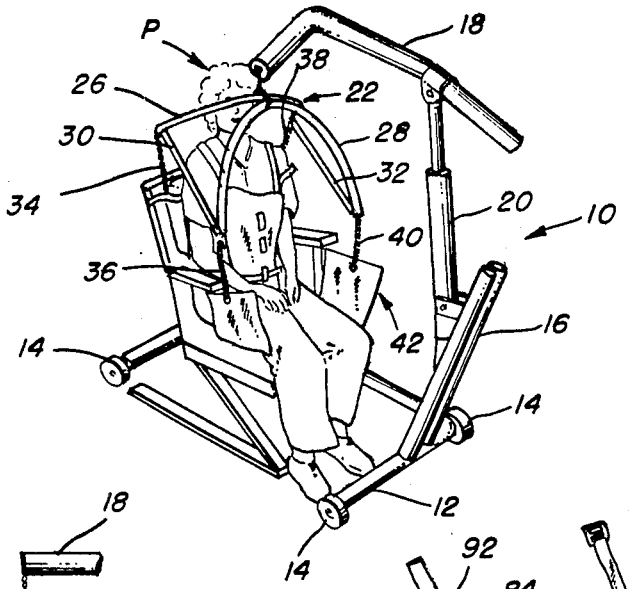
FIG. 1 is a perspective view of a patient lifting and transferring apparatus incorporating a sling constructed in accordance with the principles of the present invention, a patient being depicted as supported by the sling and just prior to being positioned into or out of a chair.
Figure 2:
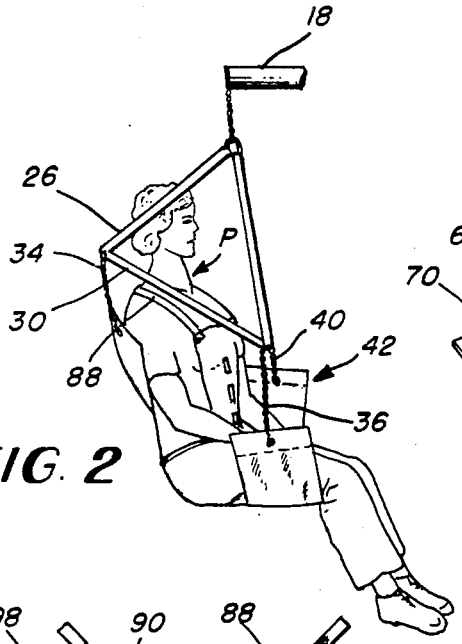
FIG. 2 is a side elevational view of the sling with the patient supported therein.
Figure 3:
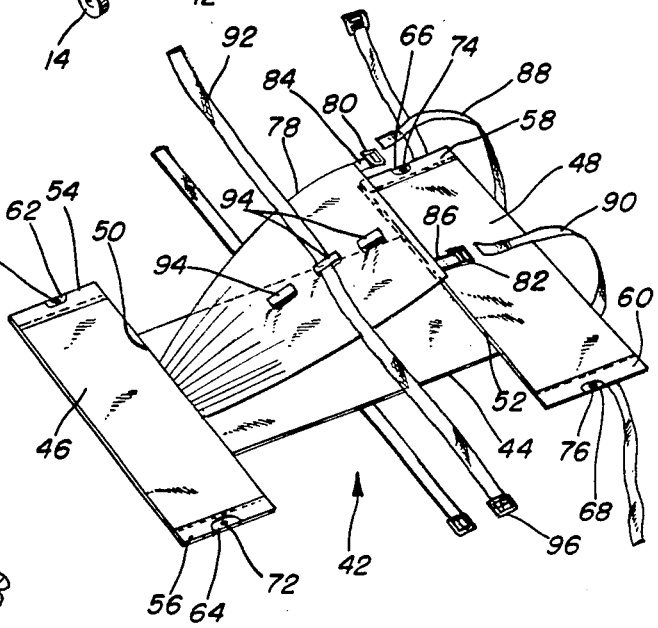
FIG. 3 is a perspective layout view of the front of the sling.
Figure 4:
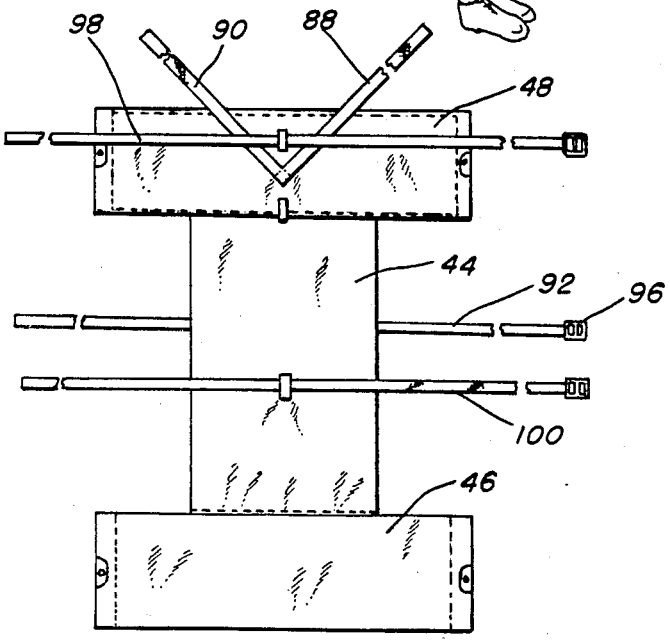
FIG. 4 is a plan view of the rear of the sling.

Referring now to the drawings, a conventional patient lifting crane is illustrated at reference number 10, the crane having a base 12 including wheels 14 for rolling on a floor and an upstanding standard 16 from which a boom 18 pivotably extends. The crane may be raised or lowered by hydraulic cylinder means 20 pivotably connected between the standard 16 and the boom 18, control members for raising and lifting not being illustrated. The details of a patient lifting crane of this general type are well known, one such apparatus being marketed by American Hospital Supply Corporation as Series No. 60920 and generally is illustrated in the aforesaid U.S. Pat. No. 4,070,721. A hanger assembly 22 is pivotably carried by a hook or chain 24 carried by the crane boom 18. The hanger assembly may include tubular yoke members 26, 28 connected together at the top where they are supported by the hooks or chains 24 and secured together between the lower ends by a pair of spaced connecting bars 30, 32 to form a rigid hanger. One end of a respective chain 34, 36, 38, 40 is attached to suspension eyelets at the location where each connecting bar 30, 32 is secured to the respective lower ends of the yoke members 26, 28.

The patient P is supported in the sling generally indicated at 42 which is carried by the chains 34, 36, 38, 40. Conventionally the sling is formed from canvas and comprises a central elongated seat panel 44 in which the patient is positioned and to which a pair of transverse panels 46, 48 are attached at the shorter marginal ends 50, 52 of the central panel 44 by means of sewn stitches or the like. Pockets 54, 56, 58, 60 may be formed by sewing at the ends of the respective transverse panels 46, 48 and respective metal bars 62, 64, 66, 68 may be enclosed in the pockets, the metal bars having holes 70, 72, 74, 76 within which the chains 34, 36, 38, 40 are secured for carrying the sling. Conventionally the patient is positioned in the sling with the panel 46 acting to support the patient's thighs and the panel 48 acting to support the patient's back at the upper portion thereof, the panel 44 acting as a seat and lower back support. Thus, when being transferred, the patient can tilt forwardly and fall out of the sling since there is no support applied to the chest and shoulders.

In accordance with the present invention an elongated security panel 78 of similar material to the remainder of the sling is attached as by stitches sewn preferably at the marginal end 50 to the central seat panel 44 at the joint with the thigh panel 46. The security panel 78 preferably may be longer than the seat panel 44 so as to extend a significant distance relative to the chest of the patient, e.g., to approximately the upper chest or breast portion. The width of the security panel 78 is not critical but to provide sufficient support may be the same as that of the seat panel 44. To comfortably fit between the legs at the crotch of the patient the end of the security panel 78 may be puckered at the marginal end 50 of the seat panel, as illustrated. Of course, the security panel may be tapered so that the secured end is narrower than the remainder of the panel to provide a wide upper support and the equivalent comfort to that of the illustrated puckered lower end.

At the upper end of the security panel 78 connecting members such as buckles 80, 82 are attached to short strap members 84, 86 which may be sewn to the panel 78. At the reverse side of the back support panel 48, a pair of elongated strap members 88, 90 are sewn at first ends thereof, the other ends being securable to the respective buckles 80, 82. After the patient is disposed in the sling the straps 88, 90 are looped over the patient's shoulders and secured to the buckles 80, 82 to tightly draw the security panel against the patient's chest thereby locking the patient in the sling prior to being lifted by the chains of the lifting crane.

An additional strap 92 may be received through a selected loop 94 formed on the front of the security panel 78 and connected at one end to a buckle 96 on the other end to provide extra security in retaining the patient in the sling. If desired additional straps 98, 100 may be connected in similar manners to the reverse side of the back panel 48 and the seat panel 44 respectively, the strap 100, for example, may pass through another of the loops 94 on the security panel. The straps 98, 100 may thus act to further secure the patient in the sling and provide the patient with an additional sense of security when being transferred.

Numerous alterations of the structure herein disclosed will suggest themselves to those skilled in the art. However, it is to be understood that the present invention relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A flexible sling for supporting a patient during transfer between supine and sitting positions by sling carrying lifting apparatus, said lifting apparatus having hanger means carrying suspension elements for attachment to said sling, said sling comprising an elongated central seat portion for supporting the buttocks and lower back portion of the patient, first and second transversely extending panels respectively joined to said central panel at remote ends of the central panel so that said panels form a generally H-shaped structure, said first panel being adapted to support the thighs of the patient and said second panel being adapted to support the upper back portion of the patient, connecting means carried by each of said first and second panels for attaching to said suspension elements, a security panel for engaging and supporting the chest portion of the patient, said security panel comprising an elongated member secured at one end to said central seat panel and said first panel at the joint therebetween for overlying said central panel and adapted to be received between the legs of the patient, and strap means for adjustably connecting the end of said security panel remote from said one end to said second panel and for engaging the shoulders of said patient for drawing said security panel securely into engagement with said chest portion.

2. A flexible sling as recited in claim 1, wherein said panels comprise fabric and said panels are secured together by stitching.

3. A flexible sling as recited in claim 1, wherein said panels comprise fabric and said panels are secured together by stitching.

4. A flexible sling as recited in claim 1, including at least one additional strap means adjustably connected to said security panel and adapted to loop about said central panel and said patient.

5. A flexible sling as recited in claim 1, wherein each of said panels comprises a substantially rectangular configuration.

6. A flexible sling as recited in claim 5, wherein said panels comprise fabric and said panels are secured together by stitching.

7. A flexible sling as recited in claim 6, wherein said security panel is puckered at said one end.

8. A flexible sling as recited in claim 1, wherein said strap means comprises buckle members fastened to said security panel adjacent the end remote from said one end, and strap means secured to said second panel and adapted for connecting to said buckles.

9. A flexible sling as recited in claim 8, wherein said panels comprise fabric and said panels are secured together by stitching.

* * * * *